US006004429A

United States Patent [19]

Schiel

[11] Patent Number: 6,004,429

[45] Date of Patent: Dec. 21, 1999

[54] MACHINE AND METHOD FOR PRODUCING A FIBROUS CREPED WEB

[75] Inventor: Christian Schiel, Murnau, Germany

[73] Assignee: Voith Sulzer Papiermaschinen GmbH, Heidenheim, Germany

[21] Appl. No.: 08/996,202

[22] Filed: Dec. 22, 1997

[30] Foreign Application Priority Data

Dec. 23, 1996 [DE] Germany ..... 196 54 198

[51] Int. Cl.[6] ..... D21F 3/04

[52] U.S. Cl. ..... 162/111; 162/206; 162/358.4; 162/359.1

[58] Field of Search ..... 162/206, 358.3, 162/359.1, 358.4, 111

[56] References Cited

U.S. PATENT DOCUMENTS

| | | | |
|---|---|---|---|
| Re. 31,923 | 6/1985 | Justus et al. | 162/358.3 |
| 4,192,713 | 3/1980 | Valkama | 162/358.1 |
| 4,880,501 | 11/1989 | Schiel | 162/358.4 |
| 5,393,384 | 2/1995 | Steiner et al. | 162/358.3 |
| 5,520,782 | 5/1996 | Schiel | 162/358.3 |
| 5,755,931 | 5/1998 | Schiel | 162/358.3 |
| 5,810,974 | 9/1998 | Laapotti | 162/359.1 |

FOREIGN PATENT DOCUMENTS

| | | | |
|---|---|---|---|
| 657579 | 6/1995 | European Pat. Off. . | |
| 3815278 | 5/1988 | Germany . | |
| 4224730 | 9/1993 | Germany . | |
| 4401580 | 6/1994 | Germany | 162/358.4 |
| 4411621 | 6/1995 | Germany | 162/358.4 |
| 1381360 | 1/1975 | United Kingdom . | |

*Primary Examiner*—Karen M. Hastings
*Attorney, Agent, or Firm*—Greenblum & Bernstein, P.L.C.

[57] ABSTRACT

A machine and method for producing a fibrous material web, in particular a tissue paper or bathroom tissue web, whereby the machine includes at least one pre-press embodied as a shoe press, a main press, in the form of a press roll, and a drying cylinder, an endless top belt guided through the nips of the pre-press and the main press, and an underfelt guided via a bottom roll of the pre-press, wherein the top belt supplies the fibrous material web that has been preformed in a former first to the pre-press and then to the main press. The pre-press, which is embodied as a shoe press and has a nip that is elongated in the web travel direction, includes an upper shoe press unit and a bottom roll disposed opposite this. The upper shoe press unit is provided with a smooth, rotating flexible press belt. The bottom roll is grooved. A relatively dense overfelt is provided as the top belt whose water permeability is lower than that of the underfelt, but in the main press when pressing against the drying cylinder, still permits the removal of additional water from the fibrous material web. The press roll associated with the main press has a perforated and/or grooved surface for absorbing expressed water.

59 Claims, 2 Drawing Sheets

MACHINE AND METHOD FOR PRODUCING A FIBROUS CREPED WEB

The present application claims the priority under 35 U.S.C. § 119 of German Patent Application No. 196 54 198.0, filed Dec. 23, 1996, the disclosure of which is expressly incorporated by reference thereto in its entirety.

BACKGROUND OF THE INVENTION

1. Field of the Invention

The invention relates to a machine for producing a fibrous material web, in particular a tissue paper or bathroom tissue web, with at least one pre-press embodied as a shoe press, a main press comprised of a press roll and a drying cylinder, an endless top belt guided through the nips of the pre-press and the main press, and an underfelt guided via a bottom roll of the pre-press, wherein the top belt supplies the fibrous material web that has been preformed in a former first to the pre-press and then to the main press. The invention also relates to the method of producing a fibrous material web by means of the machine.

Moreover, the invention also relates to a machine for producing a creped tissue paper web that is pressed onto a peripheral surface of a single tissue drying cylinder in a wet state and finish dried in contact with the surface and removed from the surface after drying by a creping doctor. The creped product can be, e.g., bathroom tissue, etc.

2. Discussion of Background Information

DE-A-42 24 730 (U.S. Pat. No. 5,393,384) has disclosed different embodiments of a bathroom tissue machine of the aforementioned type. One of these known embodiments includes a total of three press points, namely two pre-presses between two top rolls and two bottom shoe press rolls with a flexible roll jacket, as well as one main press with a press roll and a drying cylinder. The paper web is produced on a roll former between a drainage screen and a top belt. Bottom belts embodied as permeable felts are guided together with the paper web and the top belt through the two pre-presses.

According to another known embodiment, a top belt removes the paper web from a former in order to then guide it with an underfelt through a pre-press between a top roll and a bottom roll to a main press between a press roll and a drying cylinder. In another known embodiment, the press roll is a shoe press roll.

With the exception of the use of shoe presses, these known embodiments approximately correspond to two-felt tissue apparatuses that were once standard but are no longer used in the new bathroom tissue machines.

In these known two-felt tissue machines, the overfelt is very dense and the underfelt is very water-absorbent. To achieve as great a drainage as possible by means of the underfelt, the bottom roll is embodied as a suction roll.

The problem that occurs in a two-felt machine of this type which led to a rejection of this principle and instead to the current use of single felt machines is comprised of the fact that with increasing web travel speed, preparatory drainage cannot be carried out rapidly enough, even with a suction press and, as a result of an insufficient water drainage, the web is crushed in the pre-press.

For this reason, the use of a shoe press as the pre-press is actually advantageous in principle. However, in the embodiments disclosed in DE-A-42 24 730, it is among other things disadvantageous that the respective shoe press rolls are disposed in the bottom position since the paper web comes from the forming wire in a very wet state, i.e., with a dry matter content of approximately 6% to 8%.

The blind bores or grooves in the surface of the press jacket cannot absorb the entirety of the accumulating water due to their depth, which is limited for manufacture conditional reasons. This could be a reason for the fact that in most of the embodiments disclosed in DE-A-42 24 730, two pre-presses are provided and, in this instance, a suction press roll is additionally provided in the main press.

In most of the embodiments disclosed in DE-A-42 24 730, a waterproof or watertight top belt is additionally used.

In particular in comparison to a single felt machine, the known embodiments of the two-felt machine consequently take up a relatively large amount of space, particularly because in the instances mentioned, two pre-presses and a main press are provided, which main press does not remove any water on the creping cylinder.

SUMMARY OF THE INVENTION

An object of the invention, among other things, is to produce a machine of the kind mentioned above in which the aforementioned disadvantages are eliminated which, with a simple, compact design with line forces that are as low as possible, particularly immediately after the delivery of the web to the drying cylinder, ensures a relatively high web dry matter content and with which the use of any suction press rolls becomes unnecessary.

The object is attained according to the invention by virtue of the fact that the pre-press, which is embodied as a shoe press and has a nip that is elongated in the web travel direction, includes an upper shoe press unit and a bottom roll disposed opposite the shoe press unit; that the upper shoe press unit is provided with a smooth, rotating flexible press belt; that the bottom roll is grooved that a relatively dense overfelt is provided as the top belt whose water permeability is lower than that of the underfelt, but in the main press when pressing against the drying cylinder, still permits the removal of additional water from the fibrous material web; and that the press roll associated with the main press has a perforated and/or grooved surface, i.e., a recessed structured surface, for absorbing expelled water.

The aforementioned arrangement accomplishes more than merely the elimination of the aforementioned disadvantages of the known bathroom tissue machines. The machine according to the invention is also extremely uncomplicated and compact as well as being extremely efficient in terms of the web dry matter content achieved after pick-up of the paper web at the drying cylinder, which means that a maximal dry matter content of the web is achieved with line forces that are as low as possible. Also significant is the elimination of suction press rolls, which at the same time eliminates the need for the exertion of power for vacuum production, which is considerably higher than the relevant mechanical drive power. In addition, with a higher production capacity, the diameter of the drying cylinder can be kept relatively small. In the end, the machine according to the invention is also in a position to function with different pressing intensities of one or both presses, as needed, to influence quality.

As a result, there is a return to the principle of a two-felt machine which is embodied in a particular fashion according to the invention.

The invention is based, among other things, on the concept that the large quantities of water that accumulate in a single pre-press can also be managed without the vacuum of a suction press roll and that, furthermore, a higher final dry matter content of the web after the main pressing point can be achieved if the pre-press is a shoe press with an elongated nip, the top roll is a shoe press roll with a smooth press jacket, the bottom roll is a grooved roll with sufficiently deep grooves, the overfelt is in fact dense, but is still water permeable enough that when being pressed against the drying cylinder additional water can still be removed from the paper web, and the press roll of the main press has a perforated and/or grooved surface for absorbing expressed water.

With an embodiment of this kind, in a press zone of the pre-press, it is possible to drain the underfelt as well as the paper web and the overfelt in a downward direction so that after the pre-press, only a very small amount of freely mobile water remains in the paper web and in the overfelt so that not only is a crushing prevented in the main press zone, but also an additional drainage can take place despite the use of a very dense overfelt in the main press zone, by means of which the paper web at the end of the main press zone has the desired high dry matter content. By means of a second pre-press, the dry matter content of the paper web could in fact be additionally increased slightly. But it would not be economical in terms of the operating costs.

In an embodiment that is preferred in actual use, the shoe press unit of the pre-press is a shoe press roll and the associated smooth press belt is a smooth press jacket that is closed on the ends by covers that rotate along with it.

The press roll of the main press can be a conventional roll provided with an elastic rubber cover. Preferably this press roll, however, is a shoe press roll provided with a flexible roll jacket.

It is particularly advantageous if the jacket of the press roll is provided with blind bores. In this connection, when it is new, the jacket of this press roll has a bored area that is approximately 20% to approximately 35% of the total area. When the jacket is new, the hole diameter advantageously lies in a range from approximately 2 millimeters (mm) to approximately 3 mm. When the jacket is new, the hole depth can lie in a range preferably from approximately 1.5 mm to approximately 3 mm.

The line force can be higher than in a conventional press roll, wherein the pressure drop at the end of the nip preferably occurs more rapidly. In this way it is ensured that the paper web can be brought to a relatively high final dry matter content in the main press. However in order to change the paper quality, it is also possible to set the line force of both presses at arbitrary levels, e.g., low line forces for voluminous, higher qualities and higher line forces for bulk products. This kind of adjustment is not possible in the previous embodiments with conventional rolls since they only fit one another precisely with a particular line force.

Particularly with regard to a compact design that is as simple as possible, it is advantageous if starting from the pre-press, the overfelt is guided directly, i.e., in particular without interposed deflection rolls, to the press roll of the main press, which press roll is embodied as a shoe roll, and winds around this press roll over a greater sector before the press zone. This results in the prevention of the problems that previously occurred with a deflection roll of this kind, which were comprised in that a correspondingly large amount of space was required on the drying cylinder circumference, which was wasted in particular for the hot air blower cap, by means of which the production capacity of the machine was reduced.

The required space is created by virtue of the fact that the overfelt winds around the shoe press roll of the main press by more than 45°. In this winding zone, the soft press jacket should be supported from the inside. The corresponding support can in fact be produced by one or a number of sliding shoes. However, this would be connected with an additional, higher drive power. Instead of this, it is advantageously provided that at least in the region that is wound around by the overfelt, the press jacket of the press roll that is embodied as a shoe press roll is supported by small support rolls or segmented rolls disposed one after the other in the circumferential direction of the jacket, which are supported on a stationary crosshead that passes through the press jacket.

The diameter of the support rolls can, for example, lie in a range from approximately 60 mm to approximately 120 mm.

These support rolls are preferably embodied of a number of parts over the width of the machine that extends crosswise to the web travel direction. The ratio between the reciprocal spacing of the bearings of a respective support roll part and its outside diameter suitably lies in a range from approximately 7.5 to approximately 15, wherein this ratio is preferably 12. The spacing of these bearings can in particular also be less than the length of a respective support roll part.

The unsupported region between the end faces of the support roll parts of a respective series of rolls that extends in the direction of the machine width can maximally be approximately 10 mm to approximately 25 mm long. This is not critical since as a rule, the rigidity in the lateral direction of the press jacket that is curved in the travel direction is great enough to bridge this gap without sagging of any consequence.

It is particularly advantageous if the angular distance between the support rolls disposed one after the other in the circumferential direction lies in a range from approximately 7.5 degrees to approximately 15 degrees.

In order to ensure that the fibrous material web travels along with the overfelt as it leaves the pre-press, but on the other hand, in order to minimize a re-wetting by means of the underfelt, in an embodiment that is preferable in actual use, the underfelt is generally guided away from the lower press roll along a tangent that touches the bottom roll of the pre-press in the end point of the associated nip, wherein the maximal directional deviation from this tangent suitably lies in a range from approximately −2 degrees to approximately +4 degrees. Greater deviations are not favorable since a greater negative deviation can lead to a re-wetting of the underfelt by the water in the grooves of the bottom roll and a greater positive deviation can lead to a re-wetting of the paper web by the underfelt.

To ensure a rapid separation from the overfelt and underfelt, on the exit end, the overfelt and the fibrous material web have to wind around the press jacket in the convex region of the press shoe with a correspondingly large angle. In this instance, the opening angle provided directly behind the nip of the pre-press, between the underfelt and the overfelt that carries the fibrous material web along with it, preferably lies in a range from approximately 4 to approximately 15 degrees.

The line force produced in the nip of the pre-press advantageously lies in a range from approximately 60 kN/m to approximately 300 kN/m, while the nip length viewed in terms of the web travel direction preferably has a value in the range from approximately 80 mm to approximately 200 mm. The pressure produced in this nip of the pre-press progressively increases in the web travel direction up to a maximal pressure of preferably approximately 1.5 MPa to approximately 4 MPa and then drops rapidly.

In the event that a main press is used, which is embodied as a shoe press, the maximal line force produced in the nip of the main press preferably lies in a range from approximately 100 kN/m to approximately 200 kN/m. The length of the nip measured in the web travel direction preferably has a value in the range from approximately 50 mm to approximately 120 mm. The pressure produced in the nip preferably increases gradually at first in the web travel direction and then drops relatively quickly. It is particularly advantageous if the maximal pressure produced in this nip lies in a range from approximately 2.5 MPa to approximately 5 MPa if a high production capacity is what is sought.

The maximal pressures in the two presses and the structure of the grooves or blind bores in the surface of the press jacket of the main press can be matched to one another so that a maximal dry matter content is set in the fibrous material web after the main press, which takes into account a service life for the two felts that is as long as possible. The higher the line force and the maximal pressure in the pre-press are, the less water remains in the overfelt. As a result, the water quantity accumulating in the main press is small so that large flow cross sections for drainage from the overfelt are no longer necessary. The overfelt can have a fine and dense structure. A felt of this kind exerts a uniform pressure on the fibrous material web and reduces the re-wetting of the fibrous material web at the end of the nip. On the other hand, the service life of both felts is reduced by excessive pressure in the pre-press. For this reason, the overfelt is actually made much denser than the underfelt, but it is still porous enough that even in the main press, sufficient water drainage is still possible so that no losses of any consequence occur with regard to the dry matter content of the fibrous material web.

In any case, production capacity is lost if the overfelt is made so dense that the press impulse in the main press, for lack of a sufficient water drainage, does not lead to an increase of any consequence in the dry matter content of the fibrous material web.

For a corresponding optimization, in particular the following measures can now be provided:

The maximal pressure produced in the nip of the main press is advantageously higher than that in the nip of the pre-press. The water permeability of the overfelt is suitably at most ⅓, preferably at most ¼ that of the underfelt. The water permeability of the overfelt is advantageously still high enough that a dry matter content increase of the fibrous material web of more than 2% is produced in the main press. The water permeability of the overfelt is preferably selected so that after the main press, a final dry matter content of the fibrous material web of over 42% is produced.

To maximize the drainage in the main press, the surface of the press jacket of the press roll can be provided with both blind bores and grooves.

When the press jacket is new, the sum of the areas of the press jacket of the press roll that are provided with blind bores and grooves preferably makes up approximately 25% to approximately 40% of the total area.

Suitably, the depth of the grooves is approximately ⅒ to approximately ⅓ the depth of the blind bores.

The width of the grooves advantageously lies in a range from approximately 0.3 mm to 0.6 mm.

An embodiment that is preferable in actual use provides for the fact that the grooves cut down the center of the blind bores of every other row of blind bores and run centrally between the blind bores of the rows disposed between these.

An alternative suitable embodiment provides for the fact that the grooves extend in the middle between two neighboring rows of blind bores and do not intersect any blind bores.

The orientation with regard to the course of the rows is arbitrary. In both instances, though, it is suitable if the grooves extend so that the angle to the axis is the greatest.

In the region of the grooved bottom roll of the pre-press, a catch pan or channel can be provided for catching the water centrifuged from the grooves of the bottom roll.

In addition, in the region of the blind bored and grooved press roll of the main press, a catch pan or channel can be provided for catching the water centrifuged from the blind bores and grooves of the press roll.

In order to increase the drainage from the press roll jacket of the main press, this press roll can be associated with a water stripper with a water stripping squeegee that can be laid against its press jacket in a frictional, non-positive fashion.

All of the previously known methods can be used to clean the overfelt. Thus, for example, traversing, oscillating, and/or stationary spray nozzles and suction slots can be provided for cleaning this overfelt.

Alternatively or additionally, means for cleaning the overfelt in accordance with the displacement principle can also be provided in order to spray clear water that is largely free of dirt particles onto the inside of the overfelt which is then pressed into the underfelt in the pre-press by means of the overfelt and the fibrous material web. As a result, for example, dirt particles that have penetrated from the paper side can be removed. It is also particularly advantageous if means are provided for a correction of the web moisture over the width of the machine in order to be able to vary the quantity of washing water over the width of the machine. As a rule, the reaction to excessively dry strips in the paper is an increased addition of washing water.

Alternatively, a number of spray tubes charged with water of different temperatures can also be provided with a water discharge that can be regulated over the width of the machine, with which different felt temperatures can be set. As a rule, this occurs in such a way that excessively wet strips in the paper are compensated for by means of the addition of water of an increased temperature into the corresponding zones of the overfelt.

The invention also includes a method of producing a fibrous material web by means of the machine described heretofore and below.

BRIEF DESCRIPTION OF THE DRAWING

The present invention is further described in the detailed description which follows, in reference to the noted drawings by way of non-limiting examples of preferred embodiments of the present invention, wherein.

DETAILED DESCRIPTION

The particulars shown herein are by way of example and for purposes of illustrative discussion of the preferred embodiments of the present invention only, and are presented to provide what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
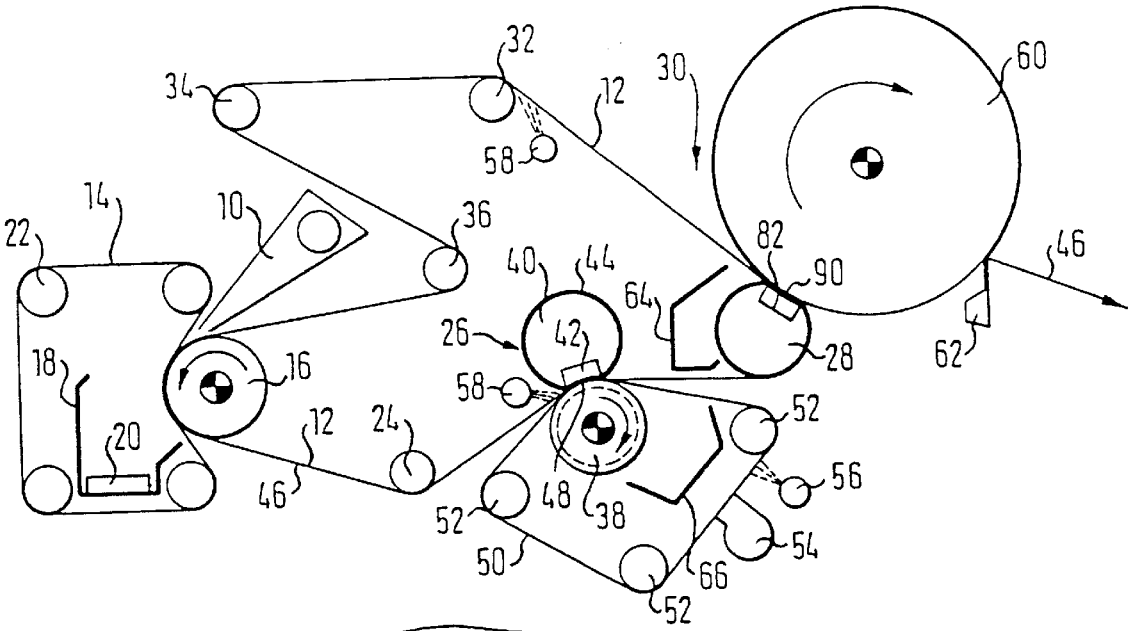
FIG. 1 is a schematic side view of a bathroom tissue machine.

The embodiment of a bathroom tissue machine shown in FIG. 1 first includes a headbox 10, an overfelt 12, and a forming wire 14, which together with the overfelt 12, encompasses a forming roll 16 and drains the fibrous suspension coming from the headbox 10.

A water catching channel 18 is provided inside the loop of the forming wire 14 and has a lateral outlet 20 for the water sprayed by the forming wire 14.

The forming wire 14 travels in the longitudinal direction, stretched via the screen guide rolls 22.

The overfelt 12 travels via a felt guide roll 24 to a pre-press 26 and via a press roll 28 of a main press 30 to a regulating roll 32 and a tension roll 34, and returns to the forming roll 16 via a felt guide roll 36.

The pre-press 26 is comprised of a grooved bottom roll 38 and an upper shoe press roll 40 with a press shoe 42 by means of which a smooth, impermeable flexible press jacket 44 can be pressed against the overfelt 12 and the grooved bottom roll 38.

A fibrous material web formed between the forming wire 14 and the overfelt 12, in the current instance, a paper web 46, travels on the underside of the overfelt 12, into the nip 48 of the pre-press 26.

Furthermore, beneath the paper web 46, an underfelt 50 travels through the nip 48. This underfelt 50 is guided in its path under circumference tension by guide rolls 52.

A suction tube 54 and a spray tube 56 are provided for cleaning the underfelt 50 during operation.

One or a number of spray tubes 58 that are disposed in the loop of the overfelt 12 are used for cleaning the overfelt 22.

After passing through the pre-press 26, the paper web 46 is pressed by the press roll 28, which is likewise embodied as a shoe press roll, against a drying cylinder 60, which together with the press roll 28 constitutes a main press 30. The paper web 46 remains stuck to the drying cylinder 60 in order to be stripped off by a creping doctor 62 after drying has been completed.

The forming roll 16, the bottom roll 38, and the drying cylinder 60 can be driven in the direction of the arrow.

A channel 64 is provided to catch the water emerging from the bores and grooves of the press roll 28.

The water centrifuged from the bottom roll 38 is caught in a channel 66 and conveyed laterally out of the bathroom tissue machine.

Figure 2:
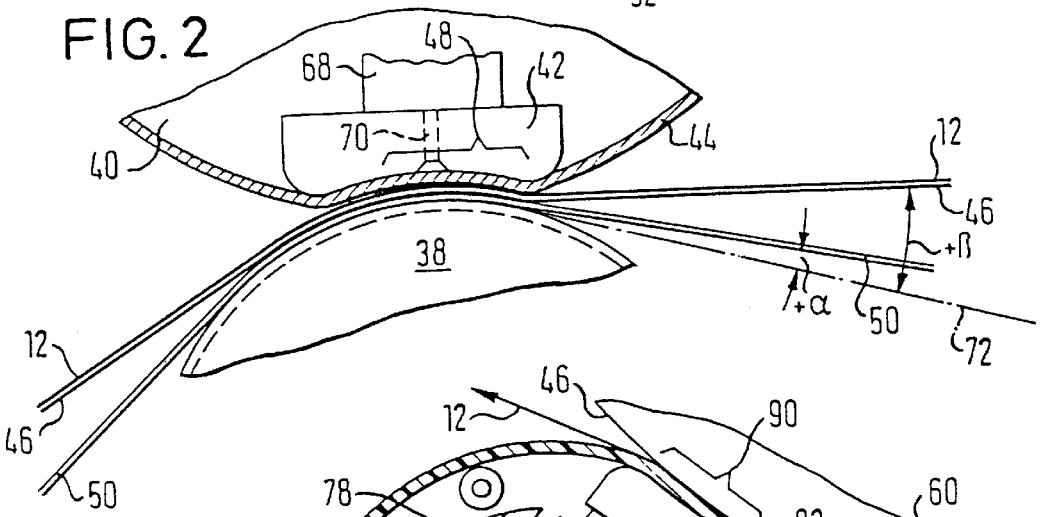
FIG. 2 is an enlarged representation of a partial section through the pre-press zone of the bathroom tissue machine shown in FIG. 1.

FIG. 2 shows a partial view of the grooved bottom roll 38 of the pre-press 26 and a partial section through the upper shoe press roll 40 with the press jacket 44 in which the press shoe 42 that can be pressed radially downward by pressing pistons 68 is held against a crosshead that is not shown.

In the instance below, the sliding face of the press shoe 42 oriented toward the press jacket 44 is hydrodynamically lubricated through the introduction of an oil film between the press shoe 42 and the press jacket 44. The lubrication can also be supplemented by means of the supply of hydraulic oil through openings 70 in the sliding face.

The press jacket 44 has both a smooth inner face and a smooth outer face.

The overfelt 12 and the paper web 46 carried along with it, as well as the underfelt 50 run from left to right through the nip 48 of the pre-press 26. After the nip 48 of the pre-press 26, the overfelt 12 travels with the paper web 46, curved upward in order to then travel further to the next roll.

The angle $\beta$ between a tangent 72 to the bottom roll 38 at the end of the nip 48 of the pre-press 26 and the approximately straight path of the overfelt 12 is selected to be of such a size that surrounding air can easily penetrate into the nip region between the overfelt 12 and the underfelt 50 if the underfelt 50 travels away from the bottom roll 38 along the tangent 72 or diverges from the direction of the tangent 72 by a small angle $\alpha$ of a few degrees. The opening angle between the overfelt 12 and the underfelt 50, i.e., the angular difference $\beta-\alpha$, should be as much larger than preferably 5 degrees as possible.

Figure 3:
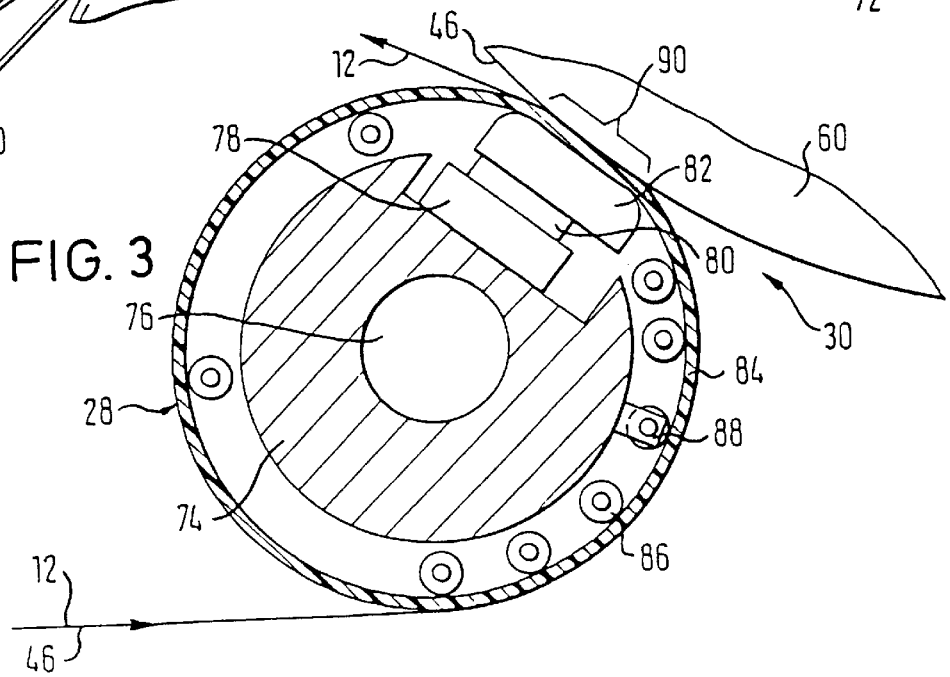
FIG. 3 is an enlarged representation of a partial section through the main press zone of the bathroom tissue machine shown in FIG. 1.

FIG. 3 shows a sectional representation of an embodiment of a press roll 28, which is embodied as a shoe press roll and is associated with the main press 30 and which has a stationary crosshead 74 that is provided with an internal bore 76 through which the supply lines, not shown, are routed.

A row of pressing cylinders 78 with pistons 80 that can move radially and can be inclined is attached to the crosshead 74, which press a pressure shoe 82 against the drying cylinder 60.

A press jacket 84 comprised of elastic plastic is supported via rotatable support rolls or segmented rolls 86. These support rolls or support rollers 86 are embodied as having a number of parts over the width of the machine and are attached with bearing supports 88 to the crosshead 74 at the ends or in the intermediary spaces between neighboring support roll parts.

The overfelt 12 and the paper web 46 carried along with it meet the circumference of press roll 28 near its lowest part. After passing through the nip 90 of the main press 30, the overfelt 12 once again travels approximately tangentially to the drying cylinder 60 at the end of the nip 90, while the paper web 46 is transported further sticking to the drying cylinder 60.

Figure 4:
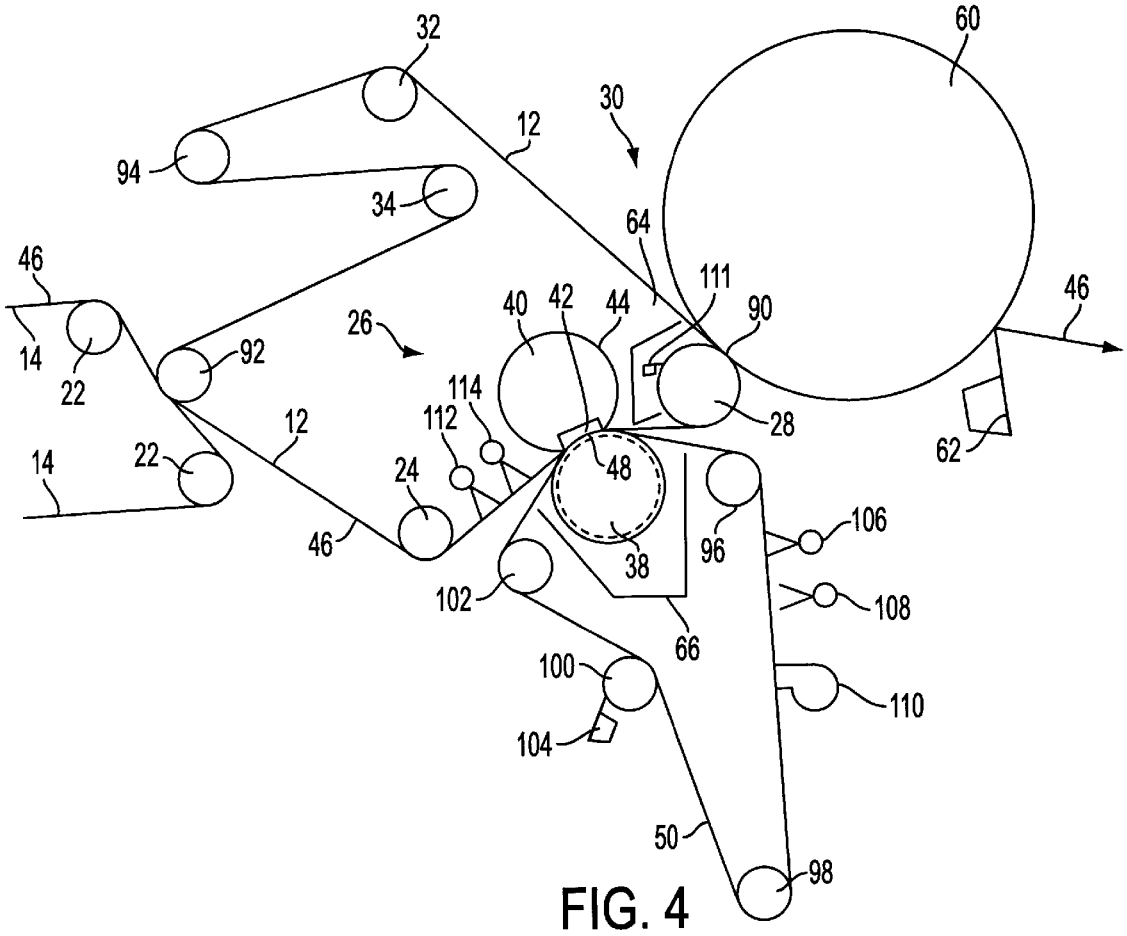
FIG. 4 is a schematic size view of another embodiment of a bathroom tissue machine.

FIG. 4 shows an embodiment of a sanitary tissue machine that is an alternative to the one shown in FIG. 1, wherein the same reference numerals are provided for parts that correspond to one another.

In this embodiment according to FIG. 4, on a forming screen or forming wire 14 that is stretched over screen guide rolls 22, the paper web 46 is pressed against a pick-up roll 92. Then it travels further to the right on the underside of the overfelt 12 via a felt guide roll 24 through the pre-press 26 and around the press roll 28 of the main press 30.

In the nip 90 of the main press 30, the paper web 46 is then transferred onto the drying cylinder 60 by which it is then creped by means of a creping doctor 62.

The overfelt 12 travels via a regulating roll 32, a guide roll 94, and a tension roll 34, back to the pick-up roll 92.

The pre-press 26 is comprised of an upper shoe press roll 40 with a press shoe 42 and a press jacket 44 that is smooth both outside and inside.

In addition, an underfelt 50 that returns via guide rolls 96 to 102, is guided through the nip 48 of the pre-press 26.

The guide roll 100 resting externally against the underfelt 50 can be associated with a doctor 104 for keeping the surface clean. Spray tubes 106, 108 and a suction tube 110 keep the underfelt 50 clean.

In the nip 90 of the main press 30, the paper web 46 is then transferred from the overfelt 12 onto the circumference of the drying cylinder 60 in order to be creped by means of the creping doctor 62 after drying is complete.

The press roll 28 of the main press 30 can be associated with a water stripper 111 with a water stripping element that can be laid against its press jacket 84 in a frictional, non-positive fashion.

Spray tubes 112 and 114 provide for the cleaning of the overfelt 12.

Just like the spray tubes 106 and 108 on the underfelt 50, the two spray tubes 112, 114 can have different functions, which, for example, include the following: one of the spray tubes can be supplied with low pressure water, one with high pressure water; one with uniform wetting of the felt face and one with deliberate wetting of particular areas of the felt; one cold water, one warm water; one supplying water, one supplying washing fluid; and/or the like.

Figure 5:
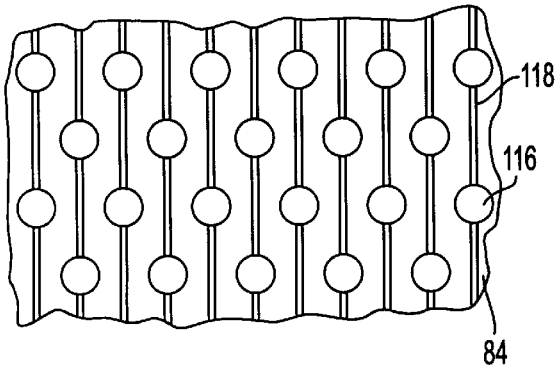
FIG. 5 shows a surface segment of a press jacket of the press roll of the main press.

FIG. 5 shows the outer surface of a press jacket 84 of the press roll 28 associated with the main press 30.

This surface contains blind bores 116 placed approximately equidistant to one another and grooves 118 that connect them. The grooves 118 are disposed so that they always cut through the centers of the blind bores 116 of every other row and, consequently, intersect the parts of the surface that are the farthest removed from the blind bores 116.

The grooves 118 are used as drainage conduits for the blind bores 116 which, in turn, are provided for temporary water storage in the nip 90 of the main press 30.

The grooves 118 are not as deep as the blind bores 116.

Figure 6:
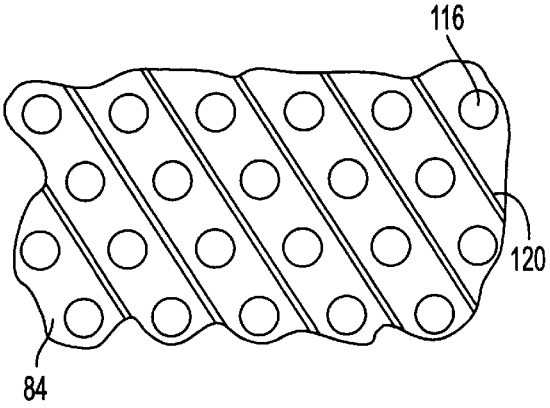
FIG. 6 shows another embodiment of a surface segment of a press jacket of the press roll of the main press.

FIG. 6 shows another configuration of blind bores 116 and grooves 120 provided in a press jacket 84. In this instance, the grooves 120 extend in parallel fashion in the space between the rows of bores.

What is claimed is:

1. A machine for producing a creped fibrous material web, said machine comprising:

a former for performing a fibrous material web;

at least one pre-press comprising a shoe press unit and a bottom roll forming a nip, the nip being elongated in a web travel direction;

a main press comprising a press roll and a tissue drying cylinder forming a nip;

an endless top belt guided through the nips of the pre-press and the main press, the top belt supplying the fibrous material web from the former to the pre-press and then to the main press;

an underfelt guided via the bottom roll of the pre-press; and a creping doctor;

wherein the shoe press unit of the pre-press is an upper shoe press unit, the bottom roll being disposed opposite the upper shoe press unit;

wherein the upper shoe press unit is provided with a smooth, rotating flexible press belt;

wherein the bottom roll is grooved;

wherein the top belt comprises a relatively dense overfelt having a water permeability lower than a water permeability of the underfelt, whereby, the top belt, pressed against the tissue drying cylinder of the main press, still permits removal of additional water from the fibrous material web; and wherein the press roll of the main press has a recessed structured surface for absorbing expelled water.

2. A machine according to claim 1, wherein said machine is a machine for producing a tissue paper web.

3. A machine according to claim 1, wherein the recess structured surface of the press roll of the main press has a perforated and/or a grooved surface.

4. A machine according to claim 1, wherein the shoe press unit of the pre-press comprises a shoe press roll and wherein the smooth press belt of the upper shoe press is a smooth press jacket.

5. A machine according to claim 1, wherein the press roll of the main press is a conventional roll provided with an elastic rubber cover.

6. A machine according to claim 1, wherein the press roll of the main press is a shoe press roll provided with a flexible roll jacket.

7. A machine according to claim 6, wherein the jacket of the press roll of the main press is provided with blind bores.

8. A machine according to claim 7, wherein the jacket of the press roll of the main press, when new, has a bored area comprising approximately 20% to approximately 35% of a total area of the press roll.

9. A machine according to claim 7, wherein the jacket of the press roll of the main press, when new, has holes with a diameter lying in a range of approximately 2 mm to approximately 3 mm.

10. A machine according to claim 8, wherein the jacket of the press roll of the main press, when new, has holes with a diameter lying within a range of approximately 2 mm to approximately 3 mm.

11. A machine according to claim 7, wherein the jacket of the press roll of the main press, when new, has holes with a depth lying within a range of approximately 1.5 mm to approximately 3 mm.

12. A machine according to claim 8, wherein the jacket of the press roll of the main press, when new, has holes with a depth lying within a range of approximately 1.5 mm to approximately 3 mm.

13. A machine according to claim 9, wherein the jacket of the press roll of the main press, when new, has holes with a depth lying within a range of approximately 1.5 mm to approximately 3 mm.

14. A machine according claim 1, wherein the overfelt is guided directly from the pre-press to the main press, there being no interposed deflection rolls between the pre-press and the main press.

15. A machine according to claim 1, wherein the press jacket of the shoe press roll of the main press, at least in a circumferential region around which the overfelt is wound, is supported by a plurality of circumferentially successively rolls, the rolls being supported on a stationary crosshead passing through the press jacket.

16. A machine according to claim 15, wherein the rolls are small support rolls or segmented rolls.

17. A machine according to claim 15, wherein rolls having a diameter lying within a range of approximately 60 mm to approximately 120 mm.

18. A machine according to claim 15, wherein the rolls are embodied by a number of parts extending over a width of the machine crosswise to a web travel direction.

19. A machine according to claim 18, wherein the rolls have respective bearing supports, a ratio between the reciprocal spacing of the bearings of a respective support roll part and its outside diameter lies in a range from approximately 7.5 to approximately 15.

20. A machine according to claim 19, wherein the ratio is approximately 12.

21. A machine according to claim 18, wherein an unsupported region between end faces of the support roll parts of a respective series of rolls that extends in the direction of the machine width is maximally approximately 10 mm to approximately 25 mm long.

22. A machine according to claim 18, wherein an angular distance between the support rolls lies in a range from approximately 7.5° to approximately 15°.

23. A machine according to claim 1, wherein the underfelt is generally guided away from the nip of the pre-press along a tangent extending from the bottom roll of the pre-press in an end point of the associated nip and a maximal directional deviation ($\alpha$) from said tangent lies in a range of approximately −2° to +4°.

24. A machine according to claim 23, wherein an opening angle ($\beta-\alpha$) provided directly behind the nip of the pre-press, between the underfelt and the overfelt that carries the fibrous material web, lies in a range of approximately 4° to approximately 15°.

25. A machine according to claim 1, wherein a line force produced in the nip of the pre-press is approximately 60 kN/m to approximately 300 kN/m and the nip length, extending along a web travel direction, is approximately 80 mm to approximately 200 mm.

26. A machine according to claim 1, wherein a pressure produced in the nip of the pre-press increases in a web travel direction up to a maximal pressure of approximately 1.5 MPa to approximately 4 MPa and then drops rapidly.

27. A machine according to claim 1, wherein the main press is a shoe press and a maximal line force produced in the nip of the main press lies in a range from approximately 100 kN/m to approximately 200 kN/m.

28. A machine according to claim 1, wherein the main press is a shoe press and, measured in a web travel direction, the length of the nip of the main press is approximately 50 mm to approximately 120 mm.

29. A machine according to claim 1, wherein the main press is a shoe press and a pressure produced in the nip of the main press increases gradually initially in a web travel direction and then drops relatively quickly.

30. A machine according to claim 1, wherein the main press is a shoe press and a maximal pressure produced in the nip of the main press lies in a range of approximately 2.5 MPa to approximately 5 MPa.

31. A machine according to claim 1, wherein a maximal pressure produced in the nip of the main press is higher than a pressure produced in the nip of the pre-press.

32. A machine according to claim 1, wherein the overfelt has a water permeability of at most ⅓ of the underfelt.

33. A machine according to claim 1, wherein the overfelt has a water permeability of at most ¼ of the underfelt.

34. A machine according to claim 1, wherein the overfelt has a water permeability high enough that a dry matter content increase of the fibrous material web of more than 2% is produced in the main press.

35. A machine according to claim 1, wherein the overfelt has a water permeability selected so that, after the main press, a final dry matter content of the fibrous material web of over 42% is produced.

36. A machine according to claim 1, wherein the press roll of the main press is a shoe press roll having a press jacket, the press jacket having a surface provided with both blind bores and grooves.

37. A machine according to claim 36, wherein the press jacket, when new, has a sum of areas provided with blind bores and grooves making up approximately 25% to approximately 40% of a total area of the press roll.

38. A machine according to claim 36, wherein the grooves have a depth of approximately 1/10 to approximately ⅓ a depth of the blind bores.

39. A machine according to claim 36, wherein the grooves have a width of approximately 0.3 mm to approximately 0.6 mm.

40. A machine according to claim 36, wherein the grooves extend through a center of the blind bores of every other row of blind bores and extend centrally between the blind bores of rows disposed between the grooves.

41. A machine according to claim 36, wherein the grooves extend in the middle between two neighboring rows of blind bores and do not intersect any blind bores.

42. A machine according claim 1, wherein in a region of the grooved bottom roll of the pre-press a catch pan is provided for catching water centrifuged from the grooves of the bottom roll.

43. A machine according to claim 36, wherein in a region of the blind bored and grooved press roll of the main press, a catch pan is provided for catching water centrifuged from the blind bores and grooves of the press roll.

44. A machine according to claim 1, wherein the press roll of the main press is associated with a water stripper with a water stripping squeegee that can be laid against a press jacket of the press roll in a frictional, non-positive fashion.

45. A machine according to claim 1, wherein spray nozzles and suction slots are provided for cleaning the overfelt.

46. A machine according to claim 45, wherein the spray nozzles comprise traversing, oscillating, or stationary spray nozzles.

47. A machine according to claim 1, further comprising a device for cleaning the overfelt in accordance with a displacement principle for spraying clear water substantially free of dirt particles onto an inside of the overfelt which is then pressed into the underfelt in the pre-press by means of the overfelt and the fibrous material web.

48. A machine according to claim 1, further comprising a device for correcting web moisture over a width of the machine, whereby the quantity of water over the width of the machine can be varied.

49. A machine according claim 1, further comprising a plurality of spray tubes charges with water of different temperatures, each of said spray tubes having a water discharge regulatable over a with of the machine for setting different felt temperatures.

50. A method of producing a creped fibrous web with a machine that includes a former for performing the web; a pre-press including an upper shoe press unit and a bottom roll, the upper shoe press unit being provided with a smooth, rotatable flexible press belt and the bottom roll being grooved, whereby a nip is formed between the upper shoe press unit and the bottom roll; a main press including a press roll and a drying cylinder forming a nip therebetween, the press roll having a recessed structured surface; an endless relatively dense overfelt guided through the nips of the pre-press and the main press; an underfelt guided by the bottom roll of the pre-press, the water permeability of the underfelt being greater than the water permeability of the overfelt, the method comprising:

performing a fibrous web at the former;

feeding the fibrous web from the former through the nip of the pre-press and then through the nip of the main press by the overfelt;

absorbing water expelled from the fibrous web via the recessed structured surface of the press roll of the main press; and creping the fibrous web.

51. A method according to claim 50, wherein feeding the fibrous web through the nip of the pre-press and then through the nip of the main press comprises feeding the fibrous web directly from the nip of the pre-press to the nip of the main press, without deviation of the path of the web via a deflection roll.

52. A method according to claim 50, further comprising producing a line force in the nip of the pre-press of approximately 60 kN/m to approximately 300 kN/m and creating a nip length, extending along a web travel direction, of approximately 80 mm to approximately 200 mm.

53. A method according to claim 50, further comprising producing a pressure in the nip of the pre-press that increases in a web travel direction up to a maximal pressure of approximately 1.5 MPa to approximately 4 MPa and then rapidly decreasing the pressure.

54. A method according to claim 50, further comprising producing a maximal line force in the nip of the main press in a range from approximately 100 kN/m to approximately 200 kN/m.

55. A method according to claim 50, further comprising creating a nip length of the main press, in a web travel direction, of approximately 50 mm to approximately 120 mm.

56. A method according to claim 50, further comprising producing a pressure in the nip of the main press that increases gradually initially in a web travel direction and then relatively quickly drops.

57. A method according to claim 50, further comprising producing a maximal pressure in the nip of the main press of approximately 2.5 MPa to approximately 5 MPa.

58. A method according to claim 50, further comprising producing a maximal pressure in the nip of the main press greater than a pressure produced in the nip of the pre-press.

59. The machine according to claim 2, wherein said machine is a machine for producing bathroom tissue paper.

* * * * *